US011147363B2

(12) United States Patent
Federici

(10) Patent No.: US 11,147,363 B2
(45) Date of Patent: Oct. 19, 2021

(54) VOLUME AND CURL ENHANCING HAIRBRUSH

(71) Applicant: Donna Federici, Sonoita, AZ (US)

(72) Inventor: Donna Federici, Sonoita, AZ (US)

( * ) Notice: Subject to any disclaimer, the term of this patent is extended or adjusted under 35 U.S.C. 154(b) by 0 days.

(21) Appl. No.: 15/912,439

(22) Filed: Mar. 5, 2018

(65) Prior Publication Data

US 2018/0249813 A1 Sep. 6, 2018

Related U.S. Application Data

(60) Provisional application No. 62/466,908, filed on Mar. 3, 2017.

(51) Int. Cl.

| | |
|---|---|
| ***A46B 9/02*** | (2006.01) |
| ***A46B 5/02*** | (2006.01) |
| ***A46B 9/06*** | (2006.01) |
| *A45D 2/00* | (2006.01) |

(52) U.S. Cl.

CPC ..... *A46B 9/023* (2013.01); *A46B 5/02* (2013.01); *A46B 9/028* (2013.01); *A46B 9/06* (2013.01); *A45D 2/00* (2013.01); *A46B 2200/104* (2013.01)

(58) Field of Classification Search

CPC .. A46B 5/02; A46B 9/06; A46B 9/028; A46B 9/023

See application file for complete search history.

(56) References Cited

U.S. PATENT DOCUMENTS

| | | | | |
|---|---|---|---|---|
| 3,186,019 | A * | 6/1965 | Ryosuke | A46B 9/06 15/179 |
| 4,861,179 | A * | 8/1989 | Schrepf | A45D 40/265 401/129 |
| 4,887,622 | A * | 12/1989 | Gueret | A45D 40/265 132/320 |
| 5,452,490 | A * | 9/1995 | Brundula | A47L 9/0477 15/179 |
| 5,482,059 | A * | 1/1996 | Miraglia | A45D 40/265 132/218 |
| 6,530,106 | B1 * | 3/2003 | Brundula | A46B 13/001 15/179 |
| 2006/0249171 | A1 * | 11/2006 | Kurek | A45D 40/262 132/218 |
| 2009/0070951 | A1 * | 3/2009 | Sever | A46B 5/002 15/143.1 |

(Continued)

*Primary Examiner* — Michael D Jennings

(74) *Attorney, Agent, or Firm* — Morgan Law Offices, PLC

(57) ABSTRACT

A hairbrush includes a main body, a first set of bristles, a second set of bristles, and a handle extending from the main body. The main body has a shape allowing the bristles of the hairbrush to be disposed around the body. Preferably, the hairbrush will have bristle sockets or the like arranged along the main body permitting a plurality of bristles to be inserted into each of the sockets. The bristles of the first set of bristles are substantially longer than the bristles of the second set of bristles. Furthermore, the bristles of the first set of bristles and the bristles of the second set of bristles will be of a different type. The first set of bristles and the second set of bristles are arranged in a stacked helical pattern around the main body. In use, the first set of bristles reach to the scalp and lift strands of hair up from the scalp, and the second set of bristles then smooth these strands. The result is to produce volume and luxurious hair.

7 Claims, 2 Drawing Sheets

(56) References Cited

U.S. PATENT DOCUMENTS

| | | | | |
|---|---|---|---|---|
| 2013/0327354 | A1* | 12/2013 | Akagi | A61C 3/005 134/6 |
| 2014/0237745 | A1* | 8/2014 | Hsu | A46B 9/023 15/160 |
| 2016/0302813 | A1* | 10/2016 | Butterfield | A61B 17/320016 |
| 2017/0258214 | A1* | 9/2017 | Borsari | A61B 90/70 |
| 2017/0258216 | A1* | 9/2017 | Chant | A46B 9/026 |
| 2018/0008034 | A1* | 1/2018 | Pires | A46B 9/06 |
| 2018/0271266 | A1* | 9/2018 | Lin | A46B 3/18 |

* cited by examiner

VOLUME AND CURL ENHANCING HAIRBRUSH

CROSS-REFERENCE TO RELATED APPLICATIONS

This application claims the benefit of provisional patent application Ser. No. 62/466,908 to Donna Federici entitled "Swerve Blow-Out Brush," filed Mar. 3, 2017, the subject matter of which is incorporated herein by reference.

BACKGROUND OF THE INVENTION

1. Field of the Invention

The present invention relates to hairbrushes, and more particularly to a hairbrush having disparate sets of bristles arranged in a stacked helical pattern to enhance volume and curl.

2. Description of the Related Art

Hair has a tendency to become tangled, snarled, and generally untidy if not cared for on a daily basis. Hence various combs and brushes have been invented for hair care. Combs have teeth that are useful for managing hair, particularly when hair is wet or needs to be parted and/or styled. Hairbrushes have bristles that stimulate the scalp, clean the hair, and spread natural oils through the hair.

Conventional hairbrushes include various types of bristles. These include bristles made of plastic, such as nylon. Some of these plastic bristles include balls on the tips. There are also natural bristles made of boar hair or the like, and blends of natural and synthetic bristle. Additionally, there are many different types of hairbrushes, including flat brushes, round brushes, teasing brushes, venting brushes, etc.

Round hairbrushes are among the most common types of hairbrushes. These can be used for general-purpose brushing, but are particularly suitable for use in conjunction with blow-drying. However, conventional round brushes have a tendency to press hair down, and it can sometimes be difficult to obtain enough volume and curl by using such a brush.

SUMMARY OF THE INVENTION

A hairbrush includes a main body, a first set of bristles, a second set of bristles, and a handle extending from the main body. The main body has a shape allowing the bristles of the hairbrush to be disposed around the body. Preferably, the hairbrush will have bristle sockets or the like arranged along the main body permitting a plurality of bristles to be inserted into each of the sockets. The bristles of the first set of bristles are substantially longer than the bristles of the second set of bristles. Furthermore, the bristles of the first set of bristles and the bristles of the second set of bristles will be of a different type. The first set of bristles and the second set of bristles are arranged in a stacked helical pattern around the main body. In use, the first set of bristles reach to the scalp and lift strands of hair up from the scalp, and the second set of bristles then smooth these strands. The result is to produce volume and luxurious hair.

DETAILED DESCRIPTION OF THE INVENTION

Figure 1:
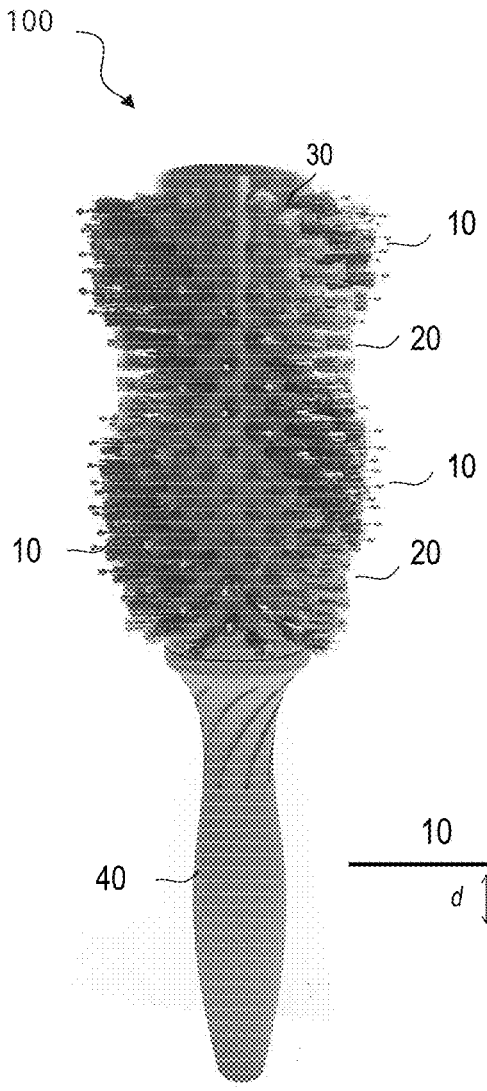
FIG. 1 illustrates an exemplary hairbrush, according to an embodiment of the present invention.

Referring to FIG. 1, an exemplary hairbrush 100, according to an embodiment of the present invention, is illustrated. The hairbrush 100 includes a main body 50, a first set of bristles 10, a second set of bristles 20, and a handle 40 extending from the main body, as shown. The main body 50 may be substantially cylindrical, as depicted, or have another suitable shape such that the bristles of the hairbrush are disposed around the main body 50. Preferably, the hairbrush 100 will have bristle sockets, such as bristle socket 30, or the like, arranged along the main body 50 permitting a plurality of bristles to be inserted into each of the sockets. The handle 40 can be any suitable shape or size, preferably providing good grip during usage. Furthermore, the handle 40 can include a hole or similar feature permitting the handle to be mounted to a wall, for example. As will be described in greater detail, unlike conventional hairbrushes that possess only a single bristle type regarding length or material choice and consistency, the present hairbrush 100 through the use of a helical bristle pattern with disparate bristle sets 10, 20, can produce a magnified effect on curl and volume of the user's hair compared to conventional hairbrushes.

Figure 2:
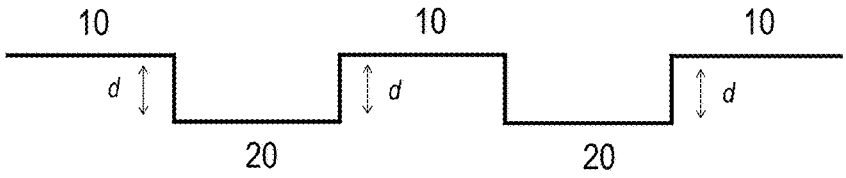
FIG. 2 illustrates relative height differential between a first set of bristles and a second set of bristles of the exemplary hairbrush, according to an embodiment of the present invention.

FIG. 2 illustrates relative height differences between the first set of bristles 10 and the second set of bristles 20 of the exemplary hairbrush 100, according to an embodiment of the present invention. As noted the main body 50 of the hairbrush 100 includes a first set of bristles 10 and a second set of bristles 20. As shown, the first set of bristles 10 includes bristles that are on average longer by a distance d than the second set of bristles 20. In an embodiment, the first set of bristles 10 are about 1 inch on average in length and the second set of bristle of bristles 20 are about 1.5 inch on average in length. In this case, the distance d would be about 0.5 inches in length, or about a 50% difference. In an embodiment the distance d is at least about 0.25 inches.

Figure 3:
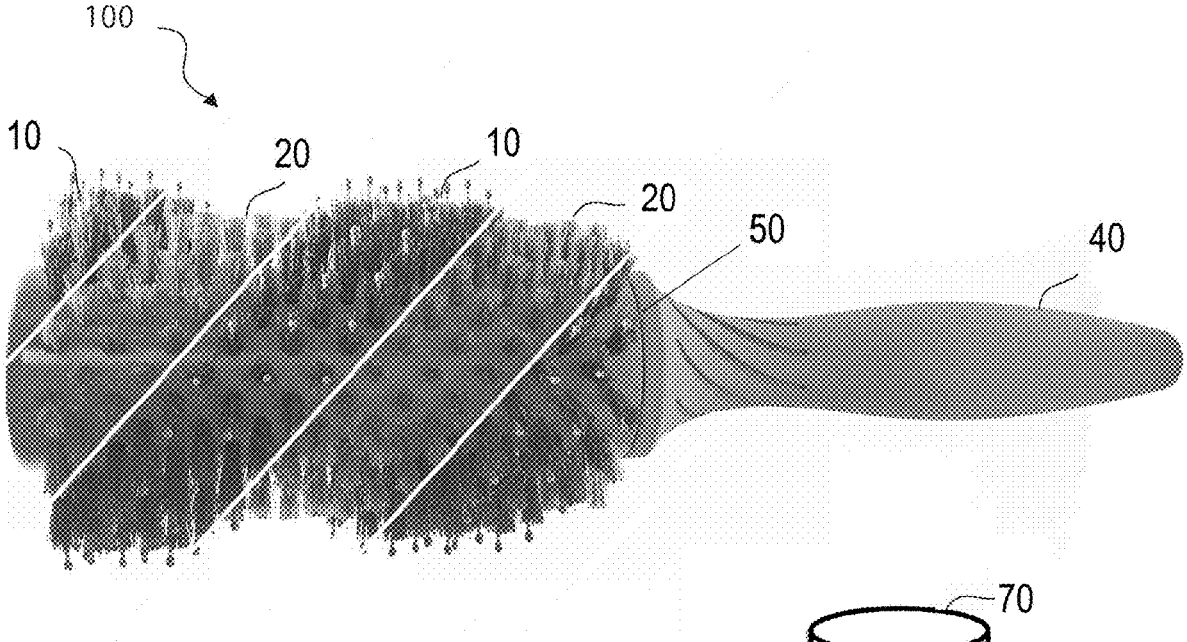
FIG. 3 illustrates the arrangement of the first set of bristles and the second set of bristles around the main body of the hairbrush, according to an embodiment of the present invention.
Figure 4:
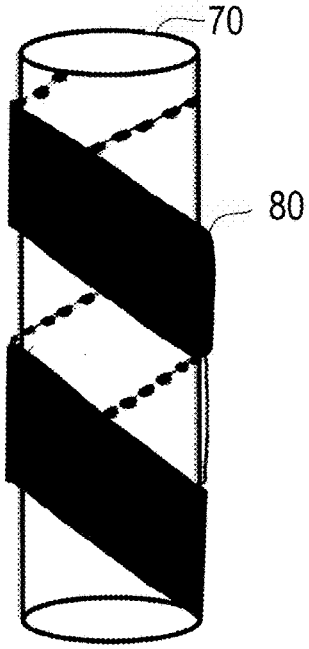
FIG. 4 illustrates a diagram graphically representing a helix, presented to aid in understanding the present invention.

FIG. 3 illustrates the arrangement of the first set of bristles 10 and the second set of bristles 20 around the main body 50 of the hairbrush 100, according to an embodiment of the present invention. As depicted, the first set of bristles 10 and the second set of bristles 20 are shown divided using white lines. It is to be understood that such lines are used herein for illustrative purposes to more distinctly show the first set of bristles 10 and the second set of bristles 20, and do not form a part of the present invention. As mentioned, the first set of bristles 10 and the second set of bristles 20 are each arranged around the main body 50 in a helical pattern. As shown, the first set of bristles 10 and the second set of bristles 20 are disposed immediately next to each other, and it is to be understood that this arrangement carries on all sides of the body 50. It is to be further understood that although side perspective views of the hairbrush 100 are shown, the first set of bristles 10 and the second set of bristles 20 actually each continue around the main body 50 in a helical arrangement. FIG. 4 illustrates a diagram graphically representing a helix 70, presented to aid in understanding the present invention. As shown, the helix 70 winds around an elongated member (in this case a cylinder) 80. A stacked helical arrangement as used herein refers to two such helixes wound around the body of the hairbrush, one helix next to the other.

As shown in FIG. 3, the first set of bristles 10 and the second set of bristles 20 have different types of bristles. In the illustrated embodiment, the first set of bristles includes synthetic bristles such as nylon bristles. These bristles can include some bristles having a ball tip and some that do not. In other embodiment, natural bristles can further be includes in the first set of bristles 10, but they will not make up a majority of the bristles therein. Notably, the bristles of the first set of bristles 10 are longer and more flexible than those of the second set of bristles. In the illustrated embodiment, the second set of bristles 20 include only natural animal hair bristles, preferably bore bristles, that are more rigid and shorter than the bristles of the first set of bristles 10. By providing such a bristle differential, the first set of bristles 10 reach to the scalp and lift strands of hair up from the scalp, and the second set of bristles 20 then smooth these strands resulting in a magnified volume and curl.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A hairbrush, comprising:

a cylindrical main body;

a first set of bristles;

a second set of bristles that are made of a different material from the first set of bristles;

a plurality of bristle sockets arranged around the main body, each of the bristle sockets holding a plurality of the bristles; and a handle extending from the cylindrical main body;

wherein the first set of bristles and the second set of bristles are grouped together;

wherein the first set of bristles and the second set of bristles are arranged as separate and distinct first and second helices, respectively, around the cylindrical main body such that the first set of bristles and the second set of bristles are separated from each other and situated immediately next to each other as each of the sets of bristles follow around the cylindrical main body;

wherein the first set of bristles and the second set of bristles each include at least two bristles of the same material and height across the width of the respective set of bristles;

wherein all the bristles of the hairbrush are distributed substantially evenly around the cylindrical main body; and wherein bristles of the first set of bristles within the first helix are of a longer length than bristles of the second set of bristles within the second helix.

2. The hairbrush of claim 1, wherein the first set of bristles and the second set of bristles extend outwardly from the cylindrical main body.

3. The hairbrush of claim 1, wherein only one of the first set of bristles and the second set of bristles includes bristles having ball tips.

4. The hairbrush of claim 1, wherein only one of the first set of bristles and the second set of bristles is natural bristle.

5. The hairbrush of claim 1, wherein only one of the first set of bristles and the second set of bristles is a blend of boar bristles and plastic bristles.

6. The hairbrush of claim 5, wherein the blend of boar bristles and plastic bristles includes plastic bristles having ball tips.

7. The hairbrush of claim 1, wherein the bristle sockets are substantially evenly spaced apart.

* * * * *